US011695257B2

(12) United States Patent
Nakano et al.

(10) Patent No.: US 11,695,257 B2
(45) Date of Patent: Jul. 4, 2023

(54) SPARK PLUG

(71) Applicant: NGK SPARK PLUG CO., LTD., Nagoya (JP)

(72) Inventors: Seiji Nakano, Nagoya (JP); Takehito Kuno, Nagoya (JP); Kota Yamauchi, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/802,334

(22) PCT Filed: Nov. 4, 2021

(86) PCT No.: PCT/JP2021/040556

§ 371 (c)(1),
(2) Date: Aug. 25, 2022

(87) PCT Pub. No.: WO2022/137824

PCT Pub. Date: Jun. 30, 2022

(65) Prior Publication Data

US 2023/0155354 A1 May 18, 2023

(30) Foreign Application Priority Data

Dec. 22, 2020 (JP) ..... JP2020-212593

(51) Int. Cl.
*H01T 13/34* (2006.01)
*H01T 13/39* (2006.01)
*H01T 13/05* (2006.01)

(52) U.S. Cl.
CPC ..... *H01T 13/39* (2013.01); *H01T 13/05* (2013.01); *H01T 13/34* (2013.01)

(58) Field of Classification Search
CPC ..... H01T 13/39; H01T 13/05; H01T 13/34
(Continued)

(56) References Cited

U.S. PATENT DOCUMENTS

2006/0158081 A1 7/2006 Shibata et al.
2016/0344164 A1* 11/2016 Firstenberg ..... C03C 3/066

FOREIGN PATENT DOCUMENTS

CN 106688046 A * 5/2017 ..... C03C 27/00
CN 110088998 A * 8/2019 ..... C03C 3/066
(Continued)

OTHER PUBLICATIONS

International Search Report from corresponding International Patent Application No. PCT/JP21/40556, dated Dec. 21, 2021.

*Primary Examiner* — Christopher M Raabe
(74) *Attorney, Agent, or Firm* — Kusner & Jaffe

(57) ABSTRACT

A spark plug has an insulator having a through hole formed along an axial direction, a center electrode which is partially inserted into a portion of the through hole on a forward end side in the axial direction, and a glass seal portion which is in contact with the insulator and the center electrode within the through hole, in which the glass seal portion contains glass and an electrically conductive substance. The glass contains an Si component and a B component in a total amount of 50 mass % or more, as reduced to $SiO_2$ and $B_2O_3$, a Zn component in an amount of 20 mass % to 35 mass % as reduced to ZnO, and an alkali metal component. The glass contains, as the alkali metal component, an Na component in an amount less than 1 mass % as reduced to $Na_2O$.

2 Claims, 2 Drawing Sheets

(58) Field of Classification Search
USPC ..... 313/118
See application file for complete search history.

(56) References Cited

FOREIGN PATENT DOCUMENTS

| | | | |
|---|---|---|---|
| JP | 2005-340171 | A | 12/2005 |
| JP | A-2007-179788 | | 7/2007 |
| JP | 2011-070890 | A | 4/2011 |
| JP | 2019-091646 | A | 6/2019 |
| JP | 2019-216067 | A | 12/2019 |

* cited by examiner

SPARK PLUG

TECHNICAL FIELD

The present disclosure relates to a spark plug.

BACKGROUND ART

Heretofore, a spark plug that includes an insulator having a through hole formed therein and a center electrode disposed in the through hole has been used as an ignition spark plug for an internal combustion engine. In the spark plug disclosed in Patent Document 1, an electrically conductive glass seal portion is disposed in the through hole whereby a seal is established between the center electrode and the insulator.

PRIOR ART DOCUMENT

Patent Document

Patent Document 1: JP-A-2007-179788

SUMMARY OF THE INVENTION

Problem to be Solved by the Invention

In the spark plug disclosed in Patent Document 1, the softening point of the glass seal portion drops due to presence of $Na_2O$ in the glass seal portion. However, the present inventors found that when the Na component of $Na_2O$ is eluted from the glass seal portion and diffuses into the insulator, the withstanding voltage of the insulator may lower. Therefore, demand has arisen for a technique capable of suppressing the lowering of the withstanding voltage of the insulator.

Means for Solving the Problem

The present disclosure can be realized as the following modes.

(1) According to an aspect of the present disclosure, there is provided a spark plug. The spark plug has an insulator having a through hole formed along an axial direction, a center electrode which is partially inserted into a portion of the through hole on a forward end side in the axial direction, and a glass seal portion which is in contact with the insulator and the center electrode within the through hole, in which the glass seal portion contains glass and an electrically conductive substance. The glass contains an Si component and a B component in a total amount of 50 mass % or more, as reduced to $SiO_2$ and $B_2O_3$, a Zn component in an amount of 20 mass % to 35 mass % as reduced to ZnO, and an alkali metal component, in which the glass contains, as the alkali metal component, an Na component in an amount less than 1 mass % as reduced to $Na_2O$. According to this spark plug, the network structure of the glass can be strengthened through entanglement of an $SiO_2$ random network (i.e., less arranged crystal structure) with a ZnO random network, since the amount of the Zn component is 20 mass % to 35 mass % as reduced to ZnO. Consequently, elution of the alkali metal component contained in the glass can be prevented, thereby suppressing the lowering of the withstanding voltage of the insulator. Since the glass contains, as the alkali metal component, an Na component in an amount less than 1 mass % as reduced to $Na_2O$, the Na component can be prevented from being eluted from the glass seal portion and diffusing into the insulator, thereby suppressing the lowering of the withstanding voltage of the insulator.

(2) In the aforementioned spark plug, the glass may contain, as the alkali metal component, a K component in an amount of 4 mass % to 8 mass % as reduced to $K_2O$. According to this spark plug, the K component (i.e., the alkali metal component) is less likely to migrate in the internal network structure of the glass, since the K component, which has a larger ionic radius than the Na component, is contained in an amount of 4 mass % to 8 mass % as reduced to $K_2O$. Consequently, elution of the alkali metal component from the glass seal portion can be prevented, thereby suppressing the lowering of the withstanding voltage of the insulator. Since incorporation of the K component as the alkali metal component can suppress an increase in the softening temperature of the glass, insufficient sintering of the glass seal portion can be prevented in a production process for the glass seal portion.

Notably, the present invention can be realized in various modes. The present invention can be realized as, for example, a method for producing a spark plug or an engine head to which a spark plug is attached.

DETAILED DESCRIPTION OF THE INVENTION

A. Embodiment

A-1. Overall Structure

Figure 1:
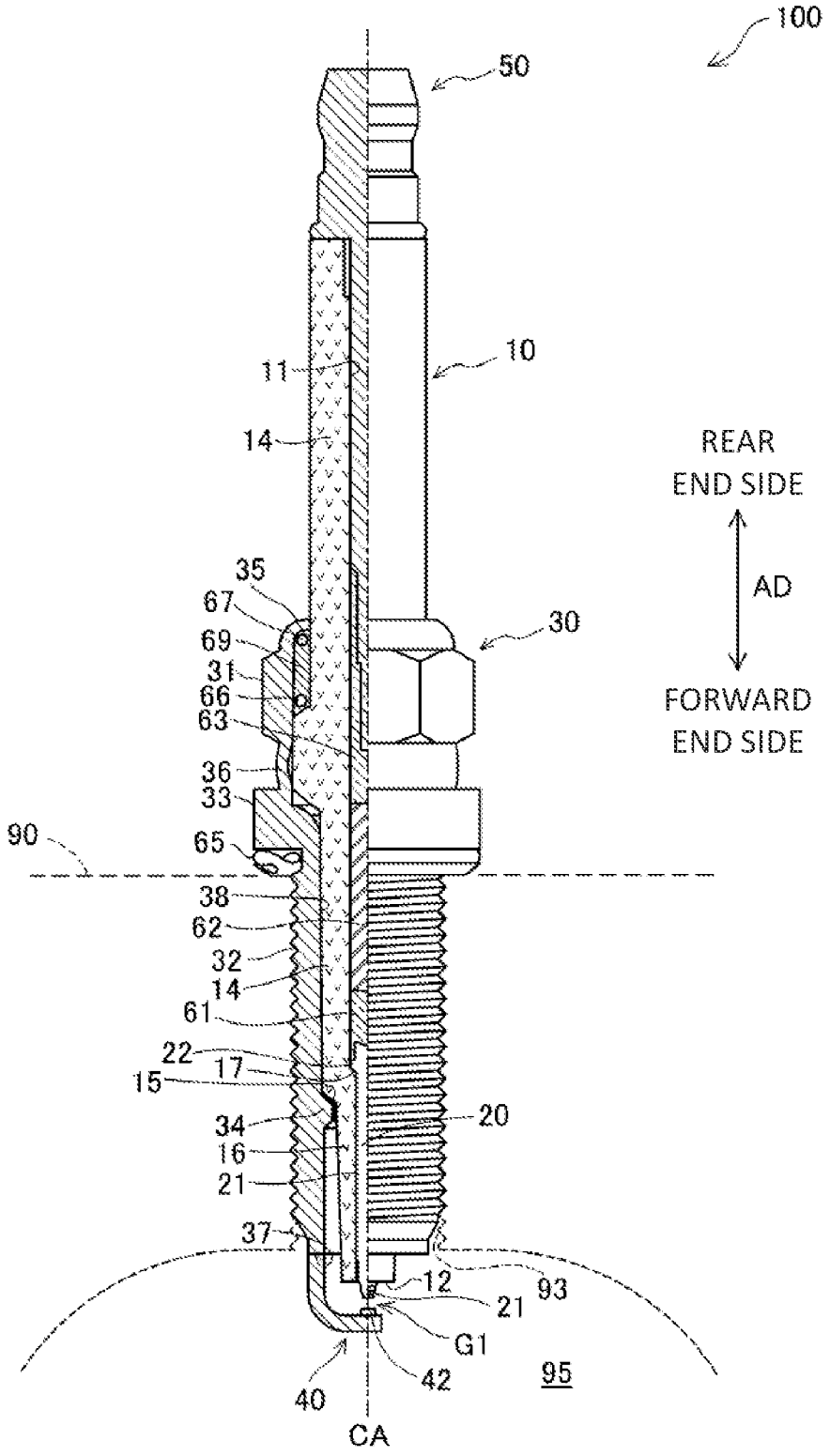
FIG. 1 is a partially sectioned view schematically showing the structure of a spark plug.

FIG. 1 is a partially sectioned view schematically showing the structure of a spark plug 100, which is one embodiment of the present disclosure. In FIG. 1, an axial line CA, which is the center axis of the spark plug 100, is depicted as a boundary line. The external shape of the spark plug 100 is shown on the left side of the sheet, and a cross-sectional shape of the spark plug 100 is shown on the right side of the sheet. In the following description, the lower side of FIG. 1 along the axial line CA (the side where a ground electrode 40, which will be described later, is disposed) will be referred to as the forward end side, the upper side of FIG. 1 (the side where a metallic terminal member 50, which will be described later, is disposed) will be referred to as the rear end side, and the direction along the axial line CA will be referred to as the axial direction AD. Notably, in FIG. 1, for convenience of description, an engine head 90 to which the spark plug 100 is attached is shown by a broken line.

The spark plug 100 includes an insulator 10, a center electrode 20, a metallic shell 30, the ground electrode 40, and the metallic terminal member 50. Notably, the axial line CA of the spark plug 100 coincides with the axial lines CA of the insulator 10, the center electrode 20, the metallic shell 30, and the metallic terminal member 50.

The insulator 10 has a through hole 11 formed along the axial direction AD and has a generally tubular external shape. In the through hole 11, a portion of the center electrode 20 is accommodated on the forward end side, and a portion of the metallic terminal member 50 is accommodated on the rear end side. An approximately half of the insulator 10 on the forward end side is accommodated in an axial hole 38 of the metallic shell 30, which will be described later, and an approximately half of the insulator 10 on the rear end side projects from the axial hole 38. The insulator 10 is composed of a ceramic insulator formed by firing a ceramic material such as alumina.

Figure 2:
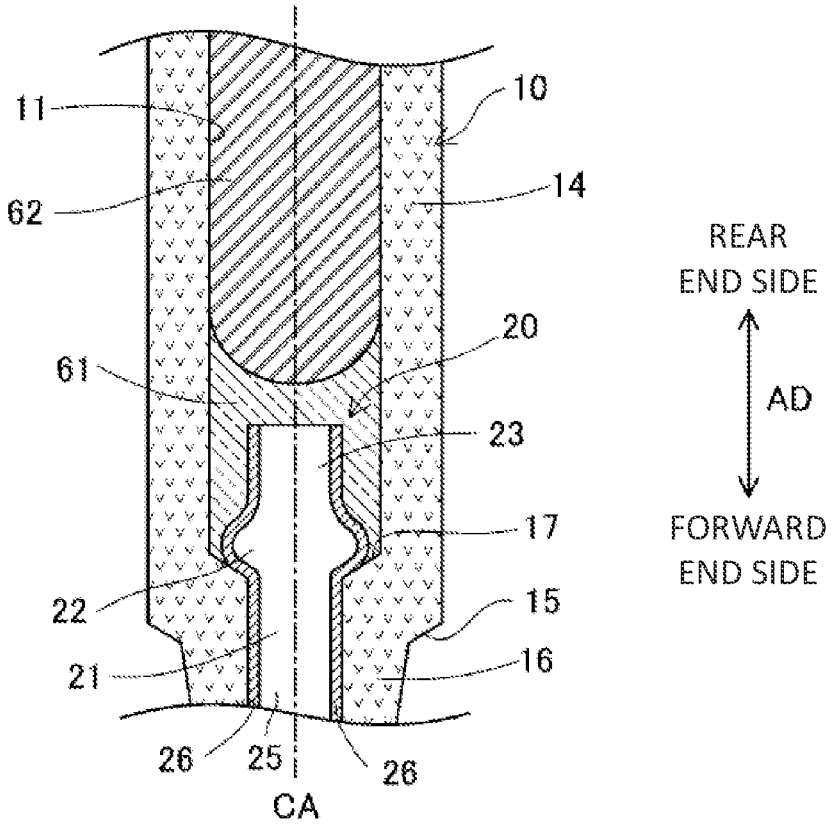
FIG. 2 is a sectional view showing the structure of a main portion.

FIG. 2 is a sectional view showing the structure of a main portion. FIG. 2 shows, on an enlarged scale, a portion of the cross section of the spark plug 100 along the axial line CA, which portion includes a glass seal portion 61, which will be described later, and its vicinity. As shown in FIGS. 1 and 2, the insulator 10 has a large diameter portion 14, an engagement portion 15, a step portion 17, and a small diameter portion 16. In the insulator 10, the large diameter portion 14 is located on the rear end side in the axial direction AD. In the large diameter portion 14, the through hole 11 has an approximately constant diameter. The engagement portion 15 is located on the forward end side of the large diameter portion 14 and is formed such that its outer diameter decreases toward the forward end side in the axial direction AD. The step portion 17 is formed such that the diameter of the through hole 11 decreases toward the forward end side in the axial direction AD. In other words, the step portion 17 is formed to protrude toward the radially inner side in the through hole 11. The step portion 17 supports a flange portion 22 of the center electrode 20. The small diameter portion 16 is located on the forward end side of the step portion 17 to be adjacent thereto and is formed such that the diameter of the through hole 11 is smaller than that at the step portion 17. A portion of a leg portion 21 of the center electrode 20, which will be described later, is accommodated in the through hole 11 of the small diameter portion 16.

As shown in FIG. 1, the center electrode 20 is a rod-shaped electrode extending in the axial direction AD. A portion of the center electrode 20 is inserted into a portion of the through hole 11 of the insulator 10, which portion is located on the forward end side in the axial direction AD. The center electrode 20 has a leg portion 21, a flange portion 22, and a head portion 23.

The leg portion 21 is formed to extend in the axial direction AD, and its portion on the forward end side projects from the through hole 11. A noble metal tip formed of, for example, an iridium alloy or the like may be joined to an end portion of the leg portion 21 on the forward end side. The flange portion 22 shown in FIGS. 1 and 2 is located on the rear end side of the leg portion 21 to be adjacent thereto and is formed such that the flange portion 22 projects toward the radially outer side in relation to the leg portion 21. The flange portion 22 butts against the step portion 17 of the insulator 10 from the rear end side, whereby the center electrode 20 is positioned within the through hole 11 of the insulator 10. The head portion 23 is located on the rear end side of the flange portion 22 to be adjacent thereto and is formed to extend in the axial direction AD.

The center electrode 20 of the present embodiment is formed by embedding a core 25 in an electrode member 26. The core 25 is excellent in thermal conductivity. In the present embodiment, the core 25 is formed of an alloy whose main component is copper, and the electrode member 26 is formed of a nickel alloy whose main component is nickel.

As shown in FIG. 1, a portion of the center electrode 20 is inserted into a forward-end-side portion of the through hole 11 of the insulator 10, and a portion of the metallic terminal member 50 is inserted into a rear-end-side portion of the through hole 11 of the insulator 10. Within the through hole 11 of the insulator 10, a glass seal portion 61, a resistor 62, and a rear-end-side seal portion 63 are disposed in this order from the forward end side toward the rear end side between the center electrode 20 and the metallic terminal member 50. Therefore, the center electrode 20 is electrically connected, on its rear end side, to the metallic terminal member 50 via the glass seal portion 61, the resistor 62, and the rear-end-side seal portion 63.

The resistor 62 is formed by using ceramic powder, conductive material, and glass as raw materials. The resistor 62 functions as an electrical resistor between the metallic terminal member 50 and the center electrode 20, thereby suppressing noise produced when spark discharge is generated. Each of the glass seal portion 61 and the rear-end-side seal portion 63 is formed to contain glass and an electrically conductive substance. The configuration of the glass seal portion 61 will be described in detail later. The glass seal portion 61 is in contact with the insulator 10 and the center electrode 20 within the through hole 11. In the present embodiment, the glass seal portion 61 is in contact with the flange portion 22, the insulator 10, and the resistor 62, and fixes these members together. Similarly, the rear-end-side seal portion 63 is in contact with the resistor 62, the insulator 10, and the metallic terminal member 50, and fixes these members together.

The metallic shell 30 has a generally tubular external shape and has an axial hole 38 formed along the axial direction AD. The metallic shell 30 holds the insulator 10 in the axial hole 38. More specifically, the metallic shell 30 surrounds and holds the insulator 10 in a region extending from a portion of the large diameter portion 14 to the small diameter portion 16. The metallic shell 30 is formed of, for example, low carbon steel, and the entirety of the metallic shell 30 is plated with, for example, nickel or zinc.

The metallic shell 30 has a tool engagement portion 31, a male screw portion 32, a bearing portion 33, a projecting portion 34, a crimp portion 35, and a compressive deformation portion 36.

When the spark plug 100 is attached to the engine head 90, an unillustrated tool is engaged with the tool engagement portion 31. The male screw portion 32 is a forward end portion of the metallic shell 30 and has a screw thread formed on its outer circumferential surface. The male screw portion 32 is screwed into a female screw portion 93 of the engine head 90. The bearing portion 33 is located on the rear end side of the male screw portion 32 to be adjacent thereto and is formed into a flange-like shape. An annular gasket 65 formed by bending a plate is inserted between the bearing portion 33 and the engine head 90. The projecting portion 34 is formed to project toward the radially inner side from the inner circumferential surface of the male screw portion 32. The engagement portion 15 of the insulator 10 butts against the projecting portion 34 from the rear end side. Therefore, the projecting portion 34 supports the insulator 10 inserted into the axial hole 38. An unillustrated annular sheet packing is disposed between the projecting portion 34 and the engagement portion 15.

The crimp portion 35 is located on the rear end side of the tool engagement portion 31 and is formed to have a small thickness. The compressive deformation portion 36 is located between the tool engagement portion 31 and the bearing portion 33 and is formed to have a small thickness. In a region which extends in the axial direction AD from the tool engagement portion 31 to the crimp portion 35, annular ring members 66 and 67 are disposed between the axial hole 38 of the metallic shell 30 and the outer circumferential surface of the large diameter portion 14 of the insulator 10, and powder of talc 69 is charged between the ring members 66 and 67. As will be described later, the metallic shell 30 is attached to the insulator 10 as a result of crimping at the crimp portion 35.

The ground electrode 40 is a bent rod-like member formed of metal. Like the center electrode 20, the ground electrode 40 is formed of a nickel alloy whose main component is nickel. One end of the ground electrode 40 is fixed to a forward end surface 37 of the metallic shell 30, and the other end of the ground electrode 40 is bent to face a forward end portion of the center electrode 20. An electrode tip 42 is provided on a portion of the ground electrode 40, which portion faces the forward end portion of the center electrode 20. A gap G1 for spark discharge is formed between the electrode tip 42 and the forward end portion of the center electrode 20. Notably, the gap G1 is also called discharge gap or spark gap.

The metallic terminal member 50 is provided at an end portion of the spark plug 100 on the rear end side. A forward-end-side portion of the metallic terminal member 50 is accommodated in the through hole 11 of the insulator 10, and a rear-end-side portion of the metallic terminal member 50 projects from the through hole 11. An unillustrated high voltage cable is connected to the metallic terminal member 50, and a high voltage is applied to the metallic terminal member 50. As a result of the application, spark discharge is generated at the gap G1. The spark discharge generated at the gap G1 ignites an air-fuel mixture within a combustion chamber 95.

A-2. Production Method

A method for producing the spark plug 100 will now be described.

First, the center electrode 20 is inserted into the through hole 11 of the insulator 10 from the rear end side. Subsequently, material powder for the glass seal portion 61 is charged into the through hole 11 from the rear end side and is compressed (hereinafter also referred to as the "seal material charging step"). Subsequently, materials for the resistor 62 are charged into the through hole 11 from the rear end side and are compressed, and material powder for the rear-end-side seal portion 63 is charged into the through hole 11 from the rear end side and is compressed. The above-described compression in each step may be performed, for example, by inserting a rod-shaped jig into the through hole 11 and pressing the jig. Subsequently, an end portion of the metallic terminal member 50 on the forward end side is inserted into the through hole 11, and a predetermined pressure is applied for compression from the metallic terminal member 50 side, while the entire insulator 10 is heated (hereinafter also referred to as the "heating and compressing step"). As a result of the heating and compressing step, the materials charged into the through hole 11 are compressed and fired. As a result, the glass seal portion 61, the resistor 62, and the rear-end-side seal portion 63 are formed in the through hole 11. Through the above-described steps, the center electrode 20 is fixed to the insulator 10.

Next, the insulator 10 with the center electrode 20 fixed thereto is inserted into the axial hole 38 of the metallic shell 30 from the rear end side. Subsequently, the metallic shell 30 and the insulator 10 are fixed to each other by crimping the crimp portion 35 of the metallic shell 30. At that time, the crimp portion 35 of the metallic shell 30 is pressed toward the forward end side while being bent radially inward, so that the compressive deformation portion 36 compressively deforms. As a result of compressive deformation of the compressive deformation portion 36, the insulator 10 is pressed toward the forward end side within the metallic shell 30 via the ring members 66 and 67 and the talc 69. Thus, the spark plug 100 is completed.

A-3. Configuration of the Glass Seal Portion

As described above, the glass seal portion 61 is formed so as to contain the glass and the electrically conductive substance. Although the electrically conductive substance is copper in the present embodiment, the electrically conductive substance may be a metal material other than copper, such as iron or brass. In the present embodiment, the glass contains an Si (silicon) component, a B (boron) component, a Zn (zinc) component, and an alkali metal component. In the spark plug 100 of the present embodiment, the lowering of the withstanding voltage of the insulator 10 is suppressed by adjusting the amounts of the components contained in the glass to fall within predetermined ranges.

In the present embodiment, the glass (100 mass %) contains an Si component in a total amount of 50 mass % or more, as reduced to $SiO_2$ (silica, silicon dioxide)) and a B component $B_2O_3$ (boron oxide)). The total amount of $SiO_2$ $B_2O_3$ contained in the glass is preferably 55 mass % or more, more preferably 60 mass % or more, from the viewpoint of improving chemical durability. The total amount of $SiO_2$ $B_2O_3$ is preferably 65 mass % or less, more preferably 60 mass % or less, from the viewpoint of lowering the softening point of the glass. The amount of the Si component, as reduced to $SiO_2$, contained in the glass is preferably 20 mass % or more from the viewpoint of improving chemical durability, and is preferably 40 mass % or less from the viewpoint of lowering the softening point of the glass. The amount of the B component, as reduced to $B_2O_3$, contained in the glass is preferably 20 mass % or more from the viewpoint of lowering the softening point of the glass, and is preferably 30 mass % or less from the viewpoint of thermal expansion.

ZnO (zinc oxide) has a function of reducing thermal expansion of the glass and increasing chemical durability. Since ZnO can provide a gentle viscosity-temperature curve, the softness of the glass seal portion 61 can be maintained when the temperature decreases in the production process for the glass seal portion 61. In the present embodiment, the glass (100 mass %) contains the Zn component in an amount of 20 mass % to 35 mass % as reduced to ZnO.

When the amount of the Zn component as reduced to ZnO is 20 mass % or more, an $SiO_2$ random network (i.e., less arranged crystal structure) is presumed to be entangled with a ZnO random network. Consequently, the network structure of the glass can be strengthened, and thus elution of the alkali metal component contained in the glass can be prevented. Therefore, the alkali metal component can be prevented from being eluted and diffusing into the insulator 10, thereby suppressing the lowering of the withstanding voltage of the insulator 10. The amount of the Zn component as reduced to ZnO is preferably 25 mass % or more from the viewpoint of further strengthening the network structure of the glass.

When the amount of the Zn component as reduced to ZnO is less than 20 mass % unlike the case of the present embodiment, the aforementioned network structure is insufficiently strengthened. Consequently, the alkali metal component contained in the glass is eluted and diffuses into the insulator, whereby the withstanding voltage of the insulator is lowered.

When the amount of the Zn component as reduced to ZnO is 35 mass % or less, the time required for solidification of the glass can be prevented from being prolonged in the production process for the glass seal portion 61. Consequently, the material of the glass seal portion 61 can be prevented from entering between the insulator 10 and the axial direction AD rear end of the leg portion 21 of the center electrode 20. Therefore, the axial direction AD rear end of the leg portion 21 can be prevented from being bonded by the glass seal portion 61, and thus the lowering of shock resistance can be suppressed. The amount of the Zn component as reduced to ZnO is preferably 30 mass % or less from the viewpoints of shortening the time required for solidification of the glass and further suppressing the lowering of shock resistance.

The alkali metal component has a function of lowering the softening temperature of the glass to thereby prevent insufficient sintering of the glass seal portion 61 in the production process for the glass seal portion 61, and a function of increasing thermal expansion to thereby suppress the lowering of gas tightness. In the present embodiment, the glass (100 mass %) contains, as the alkali metal component, an Na (sodium) component in an amount less than 1 mass % as reduced to $Na_2O$ (sodium oxide). When the amount of the Na component (as reduced to $Na_2O$) is less than 1 mass %, elution of the Na component from the glass seal portion 61 can be prevented, thereby suppressing the lowering of the withstanding voltage of the insulator 10. The amount of the Na component as reduced to $Na_2O$ is preferably less than 0.9 mass %, more preferably less than 0.3 mass %, from the viewpoint of reducing the amount of the Na component eluted, thereby suppressing the lowering of the withstanding voltage of the insulator 10. Still more preferably, the glass contains substantially no Na component.

As used herein, the phrase "contains substantially no Na component" refers to the case where an Na component is not detected by means of an electron probe micro-analyzer (EPMA) at an acceleration voltage of 15 kV and an irradiation current of 25 μA. In general, when an Na component is not detected by means of EPMA, the amount of the Na component is 0.01 mass % or less.

In the present embodiment, the glass contains a K (potassium) component as the alkali metal component. Since the K component has a larger ionic radius than the Na component, the K component is less likely to migrate in the internal network structure of the glass. Thus, the presence of the K component as the alkali metal component can lower the softening temperature of the glass as in the case of incorporation of the Na component, and can prevent elution of the alkali metal component while increasing thermal expansion. Consequently, diffusion of the alkali metal component into the insulator 10 can be prevented, and thus the lowering of the withstanding voltage can be suppressed.

The K component is preferably contained in the glass (100 mass %) in an amount of 4 mass % to 8 mass % as reduced to $K_2O$ (potassium oxide). When the amount of the K component is 4 mass % or more as reduced to $K_2O$, an increase in the softening temperature of the glass can be suppressed, and thus insufficient sintering of the glass seal portion 61 can be prevented in the production process for the glass seal portion 61. When the amount of the K component is 8 mass % or less as reduced to $K_2O$, an excessive increase in the thermal expansion of the glass seal portion 61 can be prevented. Therefore, an excessive increase in the degree of contraction of the glass seal portion 61 can be prevented during cooling in a repeated cooling/heating cycle. Consequently, occurrence of a gap at the interface between the glass seal portion 61 and the insulator 10 can be prevented, to thereby suppress the lowering of gas tightness.

In the present embodiment, the glass may contain any additional component, so long as the effects of the present invention are not impaired. Examples of such an additional component include $Al_2O_3$ (alumina, aluminum oxide), MgO (magnesia, magnesium oxide), and CaO (calcia, calcium oxide).

The amount of each component contained in the glass can be analyzed by means of an electron probe micro-analyzer (EPMA) at an acceleration voltage of 15 kV and an irradiation current of 25 μA. In the analysis by means of EPMA, a target region of a cross section of the glass seal portion 61 is photographed by means of a scanning electron microscope (SEM), and the resultant SEM image of the target region is subjected to component analysis, to thereby specify a glass phase and to determine the amount of each component in the glass phase. The target region may be, for example, a 1-$mm^2$ square region, and the magnification may be, for example, 200. The amounts of the respective components as reduced to their oxides determined through the aforementioned analysis approximately correspond to the proportions of raw material powders of the glass used for the production of the glass seal portion 61. Thus, the amounts of the respective components as reduced to the oxides can be adjusted by regulating the proportions of raw material powders of the glass.

B. Examples

The present invention will next be described in more detail by way of examples, which should not be construed as limiting the invention thereto.

(Examination of Zn Component and Alkali Metal Component)

<Sample>

Raw material powders were mixed so that the amounts of components contained in the glass of the glass seal portion 61 were as shown in Table 1 below, and samples (samples Nos. 1 to 14) of the spark plug 100 were prepared by the aforementioned production method. In the tables shown below, "Ex." or "Comp." in the "type" of each sample corresponds to Example or Comparative Example, respectively. The total amount of an Si component and a B component, as reduced to $SiO_2$ and $B_2O_3$, in each sample was 50 mass % or more. When the amount of a component is 0 mass % in the tables shown below, the component is substantially not contained in the sample.

TABLE 1

| Sample No. | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| Type | | Comp. | Ex. | Ex. | Ex. | Ex. | Comp. | Ex. | Ex. | Ex. | Ex. | Ex. | Ex. | Ex. | Comp. |
| Amount [mass %] | ZnO | 15 | 20 | 25 | 30 | 35 | 40 | 35 | 35 | 35 | 35 | 35 | 35 | 35 | 35 |
| | $K_2O$ | 8 | 8 | 8 | 8 | 8 | 8 | 2 | 4 | 6 | 10 | 8 | 8 | 8 | 8 |
| | $Na_2O$ | 0 | 0 | 0 | 0 | 0 | 0 | 0 | 0 | 0 | 0 | 0.3 | 0.6 | 0.9 | 1 |
| Evaluation results | Withstand voltage | B | A | A | A | A | A | A | A | A | A | B | B | B | C |

TABLE 1-continued

| Sample No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Type | Comp. | Ex. | Ex. | Ex. | Ex. | Comp. | Ex. | Ex. | Ex. | Ex. | Ex. | Ex. | Ex. | Comp. |
| Sintering | A | A | A | A | A | A | B | A | A | A | A | A | A | A |
| Gas tightness | A | A | A | A | A | A | A | A | A | B | A | A | A | A |
| Shock resistance | A | A | A | A | A | B | A | A | A | A | A | A | A | A |

<Evaluation of Withstanding Voltage>

Each sample shown in Table 1 was evaluated for withstanding voltage. Firstly, four samples of the spark plug 100 were prepared, and the samples were attached to a 1.6-L four-cylinder direct injection gasoline engine equipped with a supercharger. The discharge gap of the spark plug 100 was adjusted so as to achieve a discharge voltage of 40 kV or more. The engine was operated at full throttle for 100 hours (hereinafter referred to as "real machine operation"). After completion of the real machine operation, each of the four samples of the spark plug 100 was dismantled, and the insulator 10 was observed and analyzed. More specifically, a trace of the below-described through discharge was observed, and an Na component was analyzed by means of EPMA in a region (including the step portion 17) of a cross section of the insulator 10 along the axial line CA and in a region (including the step portion 17) of a cross section of the insulator 10 perpendicular to the axial line CA.

The material of the insulator 10 contains substantially no Na component. Thus, detection of an Na component in a cross section of the insulator 10 indicates that Na contained in the glass seal portion 61 is diffused into the insulator 10. Diffusion of Na into the insulator 10 may cause through discharge between the inner periphery of the step portion 17 of the insulator 10 and the outer periphery of the engagement portion 15 by the mediation of Na. When such through discharge occurs, a trace of through discharge (e.g., black point) is observed on the outer periphery of the insulator 10.

The withstanding voltage was evaluated according to the criteria described below. No trace of through discharge was detected in a sample in which Na was not detected in a cross section of the insulator 10.

A: no Na was detected in any of the cross sections of the insulators 10 of the four samples.

B: Na was detected in the cross sections of the insulators 10 of one or more samples, and no trace of through discharge was detected in any of the insulators 10 of the four samples.

C: a trace of through discharge was detected in the insulators 10 of one or more samples.

<Evaluation of Sintering>

Each sample shown in Table 1 was evaluated for sintering. Sintering is evaluated for determining whether or not the material of the glass seal portion 61 is sufficiently melted in the production process for the spark plug 100. Firstly, one sample of the spark plug 100 was newly provided, and the sample was cut to prepare a cross section along the axial line CA. The cross section was observed by means of an optical microscope. More specifically, the material powder of the glass was detected in a region including the glass seal portion 61, and it was determined whether or not a gap was generated between the glass seal portion 61 and the center electrode 20 or between the glass seal portion 61 and the insulator 10.

In the aforementioned production process for the spark plug 100, the material powder of the glass seal portion 61 is softened and compressed in the through hole 11 through the heating and compressing step. When the material of the glass seal portion 61 is sufficiently softened, particles of the material powder of the glass are not detected in a cross-sectional region including the glass seal portion 61 of the completed spark plug 100. In addition, the glass seal portion 61 adheres tightly to another member (e.g., the center electrode 20 or the insulator 10). Meanwhile, when the material of the glass seal portion 61 is insufficiently softened in the heating and compressing step, particles of the material powder of the glass are detected in a cross-sectional region including the glass seal portion 61 of the completed spark plug 100, and a gap may be generated between the glass seal portion 61 and another member.

Sintering was evaluated according to the following criteria:

A: particles of the material powder of the glass were not detected.

B: particles of the material powder of the glass were detected.

<Evaluation of Gas Tightness>

Each sample shown in Table 1 was evaluated for gas tightness. For evaluation of gas tightness, firstly, there were provided a pressurization test stand equipped with a pressurization cavity having a female screw portion similar to the female screw portion 93 of the engine head 90, and a sample of the spark plug 100. Subsequently, the sample of the spark plug 100 was attached to the pressurization cavity by screwing the male screw portion 32 of the metallic shell 30 into the female screw portion of the pressurization cavity. The interior of the pressurization cavity corresponds to the combustion chamber 95 with respect to the spark plug 100 attached to the engine head 90. While the pressure of air in the interior of the pressurization cavity was increased, the amount of air leaking from the axial direction AD rear end side of the through hole 11 of the insulator 10 was measured. The pressure was adjusted to two levels; i.e., 1.5 MPa and 2.5 MPa.

When the pressure was 1.5 MPa, no air leakage was detected in any sample. The evaluation results of gas tightness shown in Table 1 correspond to the evaluation results based on the amount of air leakage when the pressure was 2.5 MPa. The gas tightness was evaluated according to the following criteria:

A: air leakage was not detected.

B: air leakage was detected.

<Evaluation of Shock Resistance>

Each sample shown in Table 1 was evaluated for shock resistance. For evaluation of shock resistance, a shock resistance test was performed according to JIS B8031 (2006). In the test, shock (vibration amplitude: 22 mm, 400 times per minute) was applied to the sample for 30 minutes. Before and after the test, the insulation resistance between the center electrode 20 and the ground electrode 40 was measured.

The shock resistance was evaluated according to the following criteria:

A: the rate of increase in resistance (the resistance after the test with respect to the resistance before the test) was less than 5%.

B: the aforementioned rate of increase was 5% or more.

Table 2 shows the results of comparison of samples Nos. 1 to 6 shown in Table 1; specifically, different evaluation results based on different Zn component contents.

TABLE 2

| Sample No. Type | | 1 Comp. | 2 Ex. | 3 Ex. | 4 Ex. | 5 Ex. | 6 Comp. |
|---|---|---|---|---|---|---|---|
| Amount [mass %] | ZnO | 15 | 20 | 25 | 30 | 35 | 40 |
| | $K_2O$ | 8 | 8 | 8 | 8 | 8 | 8 |
| | $Na_2O$ | 0 | 0 | 0 | 0 | 0 | 0 |
| Evaluation results | Withstand voltage | B | A | A | A | A | A |
| | Sintering | A | A | A | A | A | A |
| | Gas tightness | A | A | A | A | A | A |
| | Shock resistance | A | A | A | A | A | B |

Table 2 shows the following. Specifically, samples Nos. 2 to 5 (Example) (ZnO content: 20 mass % to 35 mass %) exhibited good evaluation results in terms of withstanding voltage, sintering, gas tightness, and shock resistance. In contrast, sample No. 1 (Comparative Example) (ZnO content: 15 mass %) exhibited inferior withstanding voltage, and sample No. 6 (Comparative Example) (ZnO content: 40 mass %) exhibited inferior shock resistance.

Table 3 shows the results of comparison of samples Nos. 5 and 7 to 10 shown in Table 1: specifically, different evaluation results based on different K component contents.

TABLE 3

| Sample No. Type | | 7 Ex. | 8 Ex. | 9 Ex. | 5 Ex. | 10 Ex. |
|---|---|---|---|---|---|---|
| Amount [mass %] | ZnO | 35 | 35 | 35 | 35 | 35 |
| | $K_2O$ | 2 | 4 | 6 | 8 | 10 |
| | $Na_2O$ | 0 | 0 | 0 | 0 | 0 |
| Evaluation results | Withstand voltage | A | A | A | A | A |
| | Sintering | B | A | A | A | A |
| | Gas tightness | A | A | A | A | B |
| | Shock resistance | A | A | A | A | A |

Table 3 shows the following. Specifically, samples Nos. 7, 8, 9, 5, and 10 (Example) ($K_2O$ content: 2 mass % to 10 mass %) exhibited good evaluation results in terms of withstanding voltage, sintering, gas tightness, and shock resistance. Samples Nos. 8, 9, and 5 (Example) ($K_2O$ content: 4 mass % to 8 mass %) exhibited particularly good evaluation results in terms of sintering and gas tightness.

Table 4 shows the results of comparison of samples Nos. 5 and 11 to 14 shown in Table 1; specifically, different evaluation results based on different Na component contents.

TABLE 4

| Sample No. Type | | 5 Ex. | 11 Ex. | 12 Ex. | 13 Ex. | 14 Comp. |
|---|---|---|---|---|---|---|
| Amount [mass %] | ZnO | 35 | 35 | 35 | 35 | 35 |
| | $K_2O$ | 8 | 8 | 8 | 8 | 8 |
| | $Na_2O$ | 0 | 0.3 | 0.6 | 0.9 | 1 |
| Evaluation results | Withstand voltage | A | B | B | B | C |
| | Sintering | A | A | A | A | A |
| | Gas tightness | A | A | A | A | A |
| | Shock resistance | A | A | A | A | A |

Table 4 shows the following. Specifically, a lower $Na_2O$ content resulted in superior withstanding voltage. Sample No. 5 (Example) ($Na_2O$ content: 0 mass %) exhibited particularly good evaluation results in terms of withstanding voltage, sintering, gas tightness, and shock resistance. In contrast, sample No. 14 (Comparative Example) ($Na_2O$ content: 1 mass %) exhibited inferior withstanding voltage.

(Examination of Proportions of Amounts of Si Component and B Component)

Raw material powders were mixed so that the amounts of components contained in the glass of the glass seal portion 61 were as shown in Table 5 below, and samples (samples Nos. 2, 5, and 15) of the spark plug 100 were prepared by the aforementioned production method. Thereafter, each sample was evaluated for withstanding voltage, sintering, gas tightness, and shock resistance as described above. Table 5 shows different evaluation results based on different proportions of Si component and B component contents. Samples Nos. 2 and 5 shown in Table 5 are identical to samples Nos. 2 and 5 shown in Table 1.

TABLE 5

| Sample No. Type | | 2 Ex. | 5 Ex. | 15 Ex. |
|---|---|---|---|---|
| Amount [mass %] | $SiO_2$ | 40 | 30 | 20 |
| | $B_2O_3$ | 25 | 20 | 30 |
| | ZnO | 20 | 35 | 35 |
| | $K_2O$ | 8 | 8 | 8 |
| | $Na_2O$ | 0 | 0 | 0 |
| Evaluation results | Withstand voltage | A | A | A |
| | Sintering | A | A | A |
| | Gas tightness | A | A | A |
| | Shock resistance | A | A | A |

Table 5 shows the following. Specifically, good evaluation results were achieved in terms of withstanding voltage, sintering, gas tightness, and shock resistance, regardless of the proportions of amounts of an Si component and a B component as reduced to $SiO_2$ and $B_2O_3$. Sample No. 2 (Example) (total amount of an Si component and a B component as reduced to $SiO_2$ and $B_2O_3$: 65 mass %) and samples Nos. 5 and 15 (Example) (total amount of an Si component and a B component as reduced to $SiO_2$ and $B_2O_3$: 50 mass %) exhibited good evaluation results.

C. Other Embodiments

The structure of the spark plug 100 in the aforementioned embodiment is merely an example, and may be modified into various forms. For example, the rear-end-side seal portion 63 may be formed of the same material as that of the glass seal portion 61, or may be formed of a material different from that of the glass seal portion 61. For example, a magnetic body may be incorporated in place of or in addition to the resistor 62. Alternatively, the resistor 62 and the rear-end-side seal portion 63 may be omitted. In such an embodiment, the glass seal portion 61 may be electrically connected to the center electrode 20 and the metallic terminal member 50. For example, two or more discharge gaps may be provided, or the ground electrode 40 may be omitted. In such an embodiment, spark discharge may occur between the center electrode 20 and another member in the combustion chamber 95.

The present invention is not limited to the above-described embodiment and may be embodied in various other forms without departing from the scope of the invention. For example, the technical features in the embodiment corresponding to the technical features in the modes described in the "SUMMARY OF THE INVENTION" section can be appropriately replaced or combined in order to solve some of or all the foregoing problems or to achieve some of or all the foregoing effects. A technical feature which is not described as an essential feature in the present specification may be appropriately deleted.

DESCRIPTION OF REFERENCE NUMERALS AND SYMBOLS

10: insulator, 11: through hole, 14: large diameter portion, 15: engagement portion, 16: small diameter portion, 17: step portion, 20: center electrode, 21: leg portion, 22: flange portion, 23: head portion, 25: core, 26: electrode member, 30: metallic shell, 31: tool engagement portion, 32: male screw portion, 33: bearing portion, 34: projecting portion, 35: crimp portion, 36: compressive deformation portion, 37: forward end surface, 38: axial hole, 40: ground electrode, 42: electrode tip, 50: metallic terminal member, 61: glass seal portion, 62: resistor, 63: rear-end-side seal portion, 65: gasket, 66, 67: ring member, 69: talc, 90: engine head, 93: female screw portion, 95: combustion chamber, 100: spark plug, AD: axial direction, CA: axial line, G1: gap

What is claimed is:

1. A spark plug comprising an insulator having a through hole formed along an axial direction, a center electrode which is partially inserted into a portion of the through hole on a forward end side in the axial direction, and a glass seal portion which is in contact with the insulator and the center electrode within the through hole, in which the glass seal portion containing glass and an electrically conductive substance, wherein the glass contains:

an Si component and a B component in a total amount of 50 mass % or more, as reduced to $SiO_2$ and $B_2O_3$;

a Zn component in an amount of 20 mass % to 35 mass % as reduced to ZnO; and an alkali metal component, and the glass contains, as the alkali metal component, an Na component in an amount less than 1 mass % as reduced to $Na_2O$.

2. The spark plug according to claim 1, wherein the glass contains, as the alkali metal component, a K component in an amount of 4 mass % to 8 mass % as reduced to $K_2O$.

* * * * *